US007920819B2

(12) United States Patent
Miyake

(10) Patent No.: US 7,920,819 B2
(45) Date of Patent: Apr. 5, 2011

(54) IMAGE FORMING APPARATUS WITH SHIFTABLE GUIDE MEMBER FOR PREVENTING CURLING OF A TRANSFER MEDIUM

(75) Inventor: Takashi Miyake, Osaka (JP)

(73) Assignee: Kyocera Mita Corporation (JP)

( * ) Notice: Subject to any disclaimer, the term of this patent is extended or adjusted under 35 U.S.C. 154(b) by 148 days.

(21) Appl. No.: 12/396,111

(22) Filed: Mar. 2, 2009

(65) Prior Publication Data

US 2009/0226199 A1 Sep. 10, 2009

(30) Foreign Application Priority Data

Mar. 4, 2008 (JP) ..... 2008-053775

(51) Int. Cl.
*G03G 15/00* (2006.01)
*G03G 15/20* (2006.01)

(52) U.S. Cl. ..... 399/405; 399/45; 399/322

(58) Field of Classification Search ..... 399/45, 399/68, 322, 397, 400, 401, 405, 406
See application file for complete search history.

(56) References Cited

U.S. PATENT DOCUMENTS

| | | | | |
|---|---|---|---|---|
| 5,548,389 | A * | 8/1996 | Bowler, Jr. | 399/406 |
| 6,640,059 | B2 * | 10/2003 | Fromm et al. | 399/322 X |
| 6,965,750 | B2 * | 11/2005 | Muratani | 399/406 |
| 7,668,493 | B2 * | 2/2010 | Ruiz et al. | 399/322 |
| 2006/0291915 | A1 | 12/2006 | Takahashi | |

FOREIGN PATENT DOCUMENTS

JP 2007-10696 1/2007

* cited by examiner

*Primary Examiner* — Sandra L Brase
(74) *Attorney, Agent, or Firm* — Gerald E. Hespos; Michael J. Porco

(57) ABSTRACT

An image forming apparatus includes a fixing unit having a rotary heating member and a rotary pressure member forming a nip therebetween, a guide wall positioned immediately downstream of the fixing unit and on the side of the rotary heating member with respect to a boundary defined by the transfer medium passing the nip, a guide member positioned on the side of the rotary pressure member with respect to the boundary and face to face with the guide wall, the guide member and the guide wall cooperatively guiding the transfer medium discharged from the fixing unit, and a guide member positioning mechanism for shifting the guide member between a first position where the guide member is moved away from the guide wall and a second position where the guide member is moved closer to the guide wall than at the first position.

6 Claims, 6 Drawing Sheets

IMAGE FORMING APPARATUS WITH SHIFTABLE GUIDE MEMBER FOR PREVENTING CURLING OF A TRANSFER MEDIUM

BACKGROUND OF THE INVENTION

1. Field of the Invention

The present invention relates to an image forming apparatus configured to properly determine a discharge direction of a sheet, carrying a toner image fixed thereto by application of heat from a fixing unit, according to the type of the sheet.

2. Description of the Related Art

The Japanese Unexamined Patent Publication No. 2007-10696, for example, discloses a conventional image forming apparatus. The image forming apparatus of this Publication is so configured that a toner image is transferred from a peripheral surface of a photosensitive drum to a sheet in an image forming unit and the toner image is fixed to the sheet by application of heat in a fixing unit which includes a heating roller having a built-in heat source and a pressure roller disposed face to face with the heating roller. The toner image is fixed to the sheet as the sheet is passed through a nip formed between the heating roller and the pressure roller under conditions where the two rollers rotate in opposite directions.

In this image forming apparatus, a discharge condition of the sheet from the fixing unit can be properly set according to the type of the sheet. Specifically, the image forming apparatus is provided with a guide member located immediately downstream of the fixing unit. The guide member has a plurality of ribs along which an image carrying surface (i.e., a surface facing the heating roller) of the sheet discharged from the fixing unit is guided. These ribs include two types, that is, the first type ribs provided in a middle portion of the guide member with respect to a sheet width direction to guide thick, narrow-width sheets (such as post cards), and the second type ribs provided on both sides of the first type ribs to guide ordinary sheets. The image forming apparatus is further provided with a sheet deflection member disposed face to face with the first type ribs for forcing and deflecting the sheet discharged from the fixing unit in a direction toward the guide member.

The sheet deflection member is so structured as to be able to move toward and away from the first type ribs. When the sheet is a thick, narrow-width sheet, a driving member is actuated, causing the sheet deflection member to project toward the first type ribs, and when the sheet is an ordinary sheet, the driving member is actuated to move the first type ribs in a reverse direction, causing the sheet deflection member to return from a projected position to a home position.

When the thick, narrow-width sheet is discharged from the fixing unit, the sheet deflection member is caused to project so that the sheet is fed along the first type ribs which have been moved closer to the heating roller, thus lengthening a period of contact between the thick, narrow-width sheet which poorly absorbs toner and the heating roller. This arrangement makes it possible to carry out a fixing process in a reliable fashion and prevent a so-called toner offset phenomenon in which part of the toner image transfers to a peripheral surface of the heating roller due to incomplete execution of the fixing process.

When the thick sheet discharged from the fixing unit is pressed against the heating roller, the thick sheet which has softened as a result of application of heat bends toward the guide member. If the sheet is discharged onto a sheet delivery tray and cools in this condition, there arises a problem that the sheet assumes an inconveniently curled shape.

SUMMARY OF THE INVENTION

The present invention is intended to overcome the aforementioned problem of the sheet being curled. Accordingly, it is an object of the invention to provide an image forming apparatus which can prevent curling of a stiff sheet output from a fixing unit.

To achieve the aforementioned object, an image forming apparatus of the invention includes a fixing unit having a rotary heating member and a rotary pressure member forming a nip in between, the fixing unit operable to fix a toner image formed on a transfer medium by applying heat to the toner image while passing the transfer medium through the nip, a guide wall positioned immediately downstream of the fixing unit and closer to the rotary heating member, a guide member positioned closer to the rotary pressure member and face to face with the guide wall, the guide member and the guide wall cooperatively guiding the transfer medium discharged from the fixing unit, and a guide member positioning mechanism for shifting the guide member between a first position where the guide member is moved away from the guide wall and a second position where the guide member is moved closer to the guide wall than at the first position.

These and other objects, features and advantages of the invention will become more apparent upon a reading of the following detailed description along with the accompanying drawings.

DETAILED DESCRIPTION OF THE PREFERRED EMBODIMENTS

Figure 1:
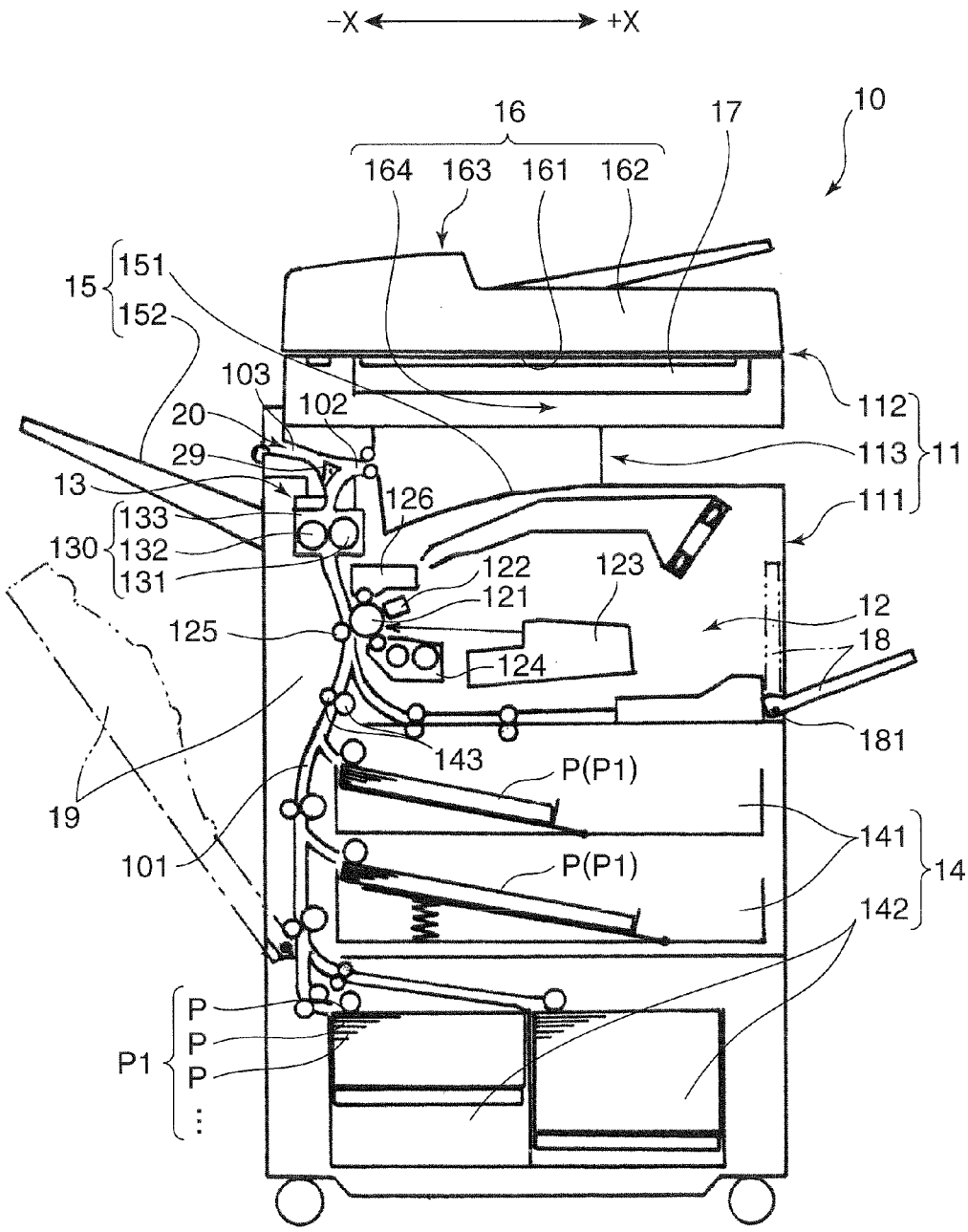
FIG. 1 is a front cross-sectional diagram generally showing the internal structure of an image forming apparatus according to a first embodiment of the invention.
Figure 2:
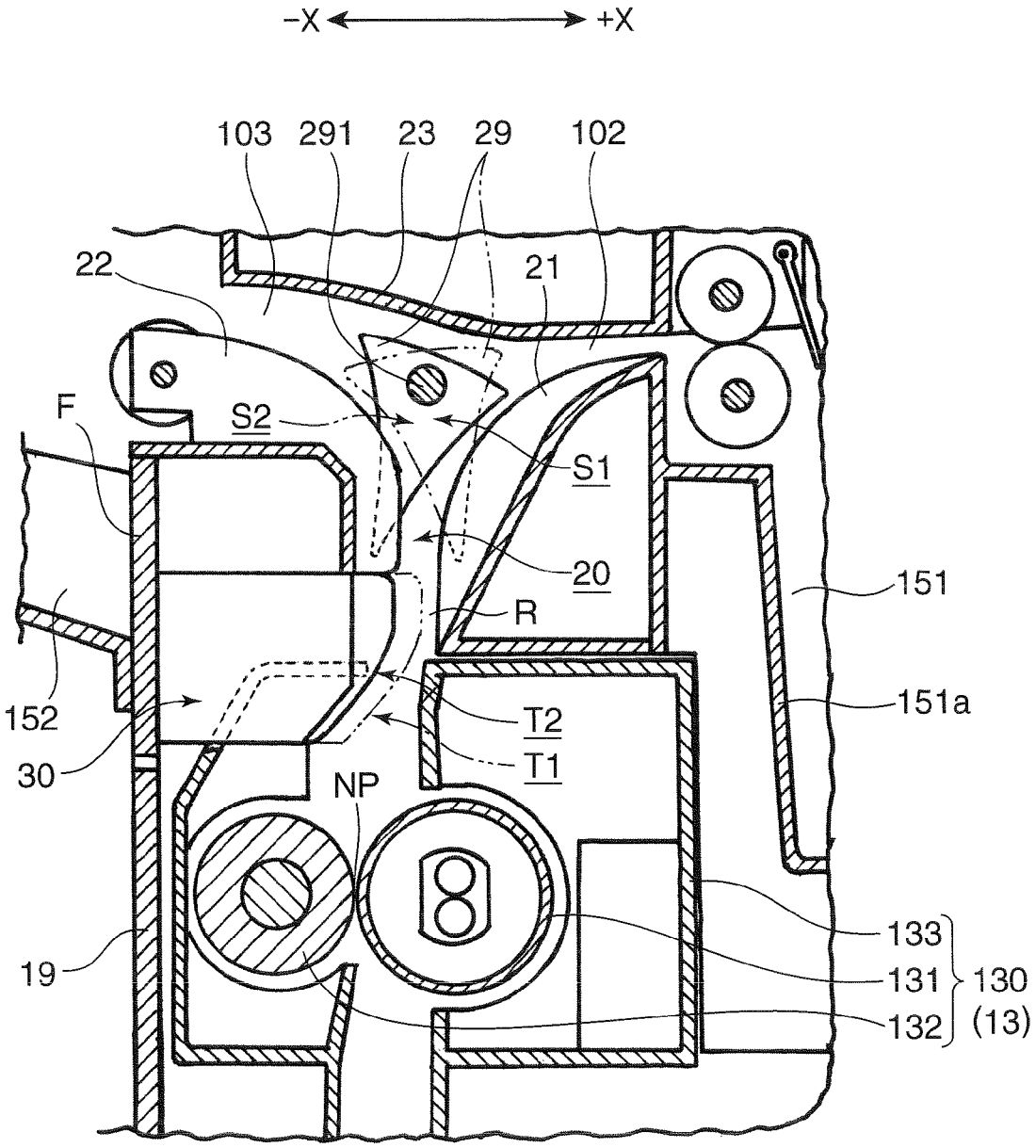
FIG. 2 is an enlarged cross-sectional diagram showing the structure around a fixing unit of the image forming apparatus of FIG. 1.

FIG. 1 is a front cross-sectional diagram generally showing the internal structure of an image forming apparatus according to a first embodiment of the invention, and FIG. 2 is an enlarged cross-sectional diagram showing the structure around a fixing unit of the image forming apparatus of FIG. 1.

As illustrated in FIGS. 1 and 2, +X/−X denotes a left-right direction, −X representing a left direction and +X representing a right direction.

As shown in FIG. 1, the image forming apparatus 10 of this embodiment is a so-called internal discharge type copying machine having a main apparatus body 11 which is provided with an image forming unit 12, a fixing unit 13, a paper storage unit 14, a sheet discharge unit 15, an image reading unit 16 and an operating unit 17. Since a later-described internal discharge tray 151 in the sheet discharge unit 15 on which individual sheets are discharged is made by forming a part of the main apparatus body 11 below the image reading unit 16 into a recessed shape, this image forming apparatus 10 is referred to as the internal discharge type.

The main apparatus body 11 includes a lower body portion 111 having generally a parallelepiped external shape, an upper body portion 112 having generally a low-height parallelepiped shape located above the lower body portion 111, and a connecting portion 113 located between the upper body portion 112 and the lower body portion 111. The connecting portion 113 is a structure for joining the lower body portion 111 and the upper body portion 112 to each other with the internal discharge tray 151 of the sheet discharge unit 15 formed in between.

The lower body portion 111 incorporates the image forming unit 12, the fixing unit 13 and the paper storage unit 14 whereas the upper body portion 112 contains the image reading unit 16. In this embodiment, the operating unit 17 projects frontward from a front end part of the upper body portion 112 (i.e., in a direction to the front side as illustrated in FIG. 1).

The operating unit 17 is used for entering information concerning an image forming task to be executed, the operating unit 17 having on a top side thereof numeric keys and various other keys for entering the number of prints to be produced on sheets (printing media) P, for instance, as well as a touch-screen-type liquid crystal display (LCD) panel which permits a user to enter information by touching a panel surface.

Provided in the paper storage unit 14 are a pair (upper and lower) of detachable paper cassettes 141 located below the image forming unit 12 and a pair (left and right) of detachable large-capacity paper decks 142 located further below the paper cassettes 141 for storing the sheets P in large quantities.

When an image forming process is initiated, the sheets P are supplied from a stack of paper P1 from the paper cassettes 141 or the large-capacity paper decks 142 and fed into the image forming unit 12 one after another for execution of the image forming process (print job).

The sheet discharge unit 15 includes the internal discharge tray 151 formed between the lower body portion 111 and the upper body portion 112 and an external discharge tray 152 formed to project outward from the main apparatus body 11. The sheet P carrying a toner image transferred thereto that is transported from the image forming unit 12 through the fixing unit 13 is discharged onto the internal discharge tray 151 or the external discharge tray 152 by a sheet guiding structure 30 and a sheet discharge direction switching member 29 of a sheet discharge direction switching mechanism 20 provided in the connecting portion 113 as will be described later in detail.

The image reading unit 16 includes a contact glass 161 fitted in an upper opening of the upper body portion 112 for placing a document to be scanned, a document pressing cover 162 which can be swung up and down for holding the document placed on the contact glass 161, an automatic document reading unit 163 mounted in the document pressing cover 162 and a scanner mechanism 164 for scanning an image of the document placed on the contact glass 161.

The image of the document which is placed on the contact glass 161 or fed onto the contact glass 161 by the automatic document reading unit 163 is read in the form of analog information by the scanner mechanism 164 and this information is converted into a digital signal which is output to a later-described exposure unit 123.

Provided on a right side of the lower body portion 111 immediately above the paper storage unit 14 is a manual feed tray 18. The manual feed tray 18 is mounted swingably on a pivot shaft 181 at a lower end so that the manual feed tray 18 can be flipped up and down between a closed position at which the manual feed tray 18 closes off a manual feed slot and an open position at which the manual feed tray 18 projects in the rightward direction. Sheets P are manually fed one by one when the manual feed tray 18 is set to the open position. The sheet P manually fed from the manual feed tray 18 is transported toward a nip formed between a photosensitive drum 121 and a transfer roller 125 through a sheet transport path 101.

Provided on a left side of the lower body portion 111 is a maintenance door 19 which can be opened and closed. If a paper jam occurs in the sheet transport path 101, the user (or service personnel) can flip down the maintenance door 19 to an open position to expose the sheet transport path 101 so that the jammed sheet P can easily be removed.

The external discharge tray 152 is provided at a position above the maintenance door 19. Upon completion of the print job in the image forming unit 12, the sheet P carrying a printed image is discharged selectively onto the internal discharge tray 151 or the external discharge tray 152.

The photosensitive drum 121 is provided in the image forming unit 12 at approximately a mid-height position of the main apparatus body 11 close to the left side thereof. While the photosensitive drum 121 rotates in a clockwise direction about a drum axis, a peripheral surface of the photosensitive drum 121 is uniformly charged by a charging unit 122 which is located immediately to the right of the photosensitive drum 121.

Positioned rightward of the charging unit 122 is the exposure unit 123 which projects a laser beam according to image information representative of the document image read by the image reading unit 16. When the laser beam is projected onto the peripheral surface of the photosensitive drum 121 from the exposure unit 123, an electrostatic latent image is formed on the peripheral surface of the photosensitive drum 121. As toner is supplied from a developing unit 124, provided below the photosensitive drum 121, to the electrostatic latent image subsequently, a toner image is formed on the photosensitive drum 121.

The sheet P supplied from one of the paper cassettes 141 and the large-capacity paper decks 142 is fed along the vertically extending sheet transport path 101 up to the photosensitive drum 121, on which the toner image is formed, through a pair of registration rollers 143 which serve to feed the sheet P with correct timing. The transfer roller 125 is disposed face to face with the photosensitive drum 121 on the left side thereof. As the sheet P is nipped between the photosensitive drum 121 and the transfer roller 125, the toner image on the peripheral surface of the photosensitive drum 121 is transferred onto the sheet P. The sheet P carrying the transferred toner image is fed from the photosensitive drum 121 into the fixing unit 13.

As the photosensitive drum 121 continues to rotate in the clockwise direction upon completion of the image transfer process, the peripheral surface of the photosensitive drum 121 is cleaned by a cleaning unit 126 provided immediately above the photosensitive drum 121. Then, the peripheral surface of the photosensitive drum 121 is charged again by the charging unit 122 in preparation of a succeeding image forming process.

The fixing unit 13 includes the fixing device 130 which is provided with a fixing roller (rotary heating member) 131 having a built-in electric heating element such as a halogen lamp, a pressure roller (rotary pressure member) 132 having a peripheral surface disposed face to face with a peripheral surface of the fixing roller 131, and a housing 133 in which the fixing roller 131 and the pressure roller 132 are mounted. As the sheet P fed from the image forming unit 12 passes through a nip NP (refer to FIG. 2) between the fixing roller 131 and the pressure roller 132, the sheet P receives heat from the fixing roller 131 and, as a result, the toner image is fixed to the sheet P.

The sheet discharge direction switching mechanism 20 is positioned above the fixing unit 13. In the sheet discharge direction switching mechanism 20, there are formed a first sheet discharge path 102 extending to the internal discharge tray 151 and a second sheet discharge path 103 extending to the external discharge tray 152. The sheet discharge direction switching mechanism 20 includes the sheet discharge direction switching member 29 for switching between the first sheet discharge path 102 and the second sheet discharge path 103. Upon completion of the fixing process, the sheet P is discharged onto the internal discharge tray 151 through the first sheet discharge path 102 or onto the external discharge tray 152 through the second sheet discharge path 103 depending on the position of the sheet discharge direction switching member 29.

Now, the operation of the sheet discharge direction switching mechanism 20 is described in detail with reference to FIG. 2. The sheet discharge direction switching mechanism 20 is located in a space to the left of a left side wall 151*a* of the internal discharge tray 151 and immediately above the housing 133 of the fixing device 130. The sheet discharge direction switching member 29 is positioned approximately above the nip NP formed between the fixing roller 131 and the pressure roller 132 which are in contact with each other. As the sheet discharge direction switching member 29 is made swingable in either direction (clockwise or counterclockwise as illustrated) about a pivot shaft 291 extending along a front-rear direction (i.e., a direction perpendicular to the plane of FIG. 2), the sheet discharge direction switching member 29 can be moved between a first guiding position S1 shown by solid lines and a second guiding position S2 shown by alternate long and two short dashed lines.

On the right side of the sheet discharge direction switching member 29, there is provided a plurality of guiding fins (guide wall) 21 each having an arcuate left end surface. When the sheet discharge direction switching member 29 is at the first guiding position S1, the guiding fins 21 cooperate with the sheet discharge direction switching member 29 to guide the sheet P to the internal discharge tray 151. On the left side of the sheet discharge direction switching member 29, there is provided a plurality of guiding fins 22. When the sheet discharge direction switching member 29 is at the externally guiding position S2, the guiding fins 22 cooperate with the sheet discharge direction switching member 29 to guide the sheet P to the external discharge tray 152. Left end surfaces of the guiding fins 21 forms the guide wall.

There is provided a ceiling panel 23 extending approximately along a horizontal plane above the sheet discharge direction switching member 29. The first sheet discharge path 102 is formed between a right-hand part of the ceiling panel 23 and an upper part of the guiding fins 21. On the other hand, the second sheet discharge path 103 is formed between a left-hand part of the ceiling panel 23 and an upper part of the guiding fins 22.

The sheet guiding structure 30 is provided between the guiding fins 22 of the sheet discharge direction switching mechanism 20 and a left-hand upper part of the housing 133 of the fixing device 130 for guiding the sheet P which has just been fed upward from the nip NP of the fixing device 130. The guiding fins 21 and the guide member 30 are positioned immediately downstream of the fixing device 130, and more specifically, with a later-described sheet path R formed between the guiding fins 21 and the guiding member 30, the guiding fins 21 are positioned on the side of the fixing roller 131 with respect to a boundary defined by the sheet P passing the nip NP whereas the guide member 30 is positioned on the side of the pressure roller 132 with respect to the boundary. The sheet P discharged from the fixing device 130 is first guided by the sheet guiding structure 30 and fed to the sheet discharge direction switching member 29.

A right surface of the sheet guiding structure 30 serving as a guide surface for guiding the sheet P is configured to move close to and away from a lower part of the guiding fins 21. As the right surface of the sheet guiding structure 30 can be moved in this way, it is possible to vary the distance between a right end surface of a later-described boxlike guide member 40 of the sheet guiding structure 30 and the lower part of the guiding fins 21. There is a sheet path R formed between the right end surface of the boxlike guide member 40 and the guiding fins 21, especially the lower part of the guiding fins 21 for passing the sheet P discharged from the nip NP, and the width of the sheet path R can be adjusted. Reasons why the embodiment employs this configuration are as explained below.

When an ordinary sheet (pliable transfer medium) P which has become more flexible due to application of heat in the fixing device 130 is fed upward beyond the housing 133 of the fixing device 130, it is preferable that the distance between the right end surface of the boxlike guide member 40 and left end surfaces of the guiding fins 21 (i.e., the width of the sheet path R) be as small as possible. This is because if the distance is large, the sheet P could bend and would not be fed properly upward along the sheet path R. Thus, the distance between the right end surface of the boxlike guide member 40 and the left end surfaces of the guiding fins 21 should preferably be as small as possible to prevent a paper feed problem. For this reason, the right end surface of the boxlike guide member 40 is approached toward the left end surfaces of the guiding fins 21 as much as possible as shown by alternate long and two short dashed lines in FIG. 2 when the sheet P is an ordinary sheet which is pliable.

On the other hand, if the distance between the right end surface of the boxlike guide member 40 and the left end surfaces of the guiding fins 21 is small when the sheet P is a stiff sheet (stiff transfer medium) like a post card, the sheet P which has become flexible due to application of heat in the fixing process would be forced rightward by the right end surface of the boxlike guide member 40 and curl leftward when forced against the arcuate left end surfaces of the guiding fins 21. If the sheet P so curled is discharged onto the internal discharge tray 151, the sheet P cools in this condition, causing a problem that the sheet P assumes an inconveniently curled shape.

To prevent this problem, the right end surface of the boxlike guide member 40 is set apart from the left end surfaces of the guiding fins 21 as much as possible as shown by solid lines in FIG. 2 when the sheet P is of a stiff type. The boxlike guide member 40 is so positioned that the right end surface thereof would not force the sheet P rightward at a position immediately downstream of an outlet of the fixing device 130 where the sheet P is most apt to be bent or curled.

Figure 3:
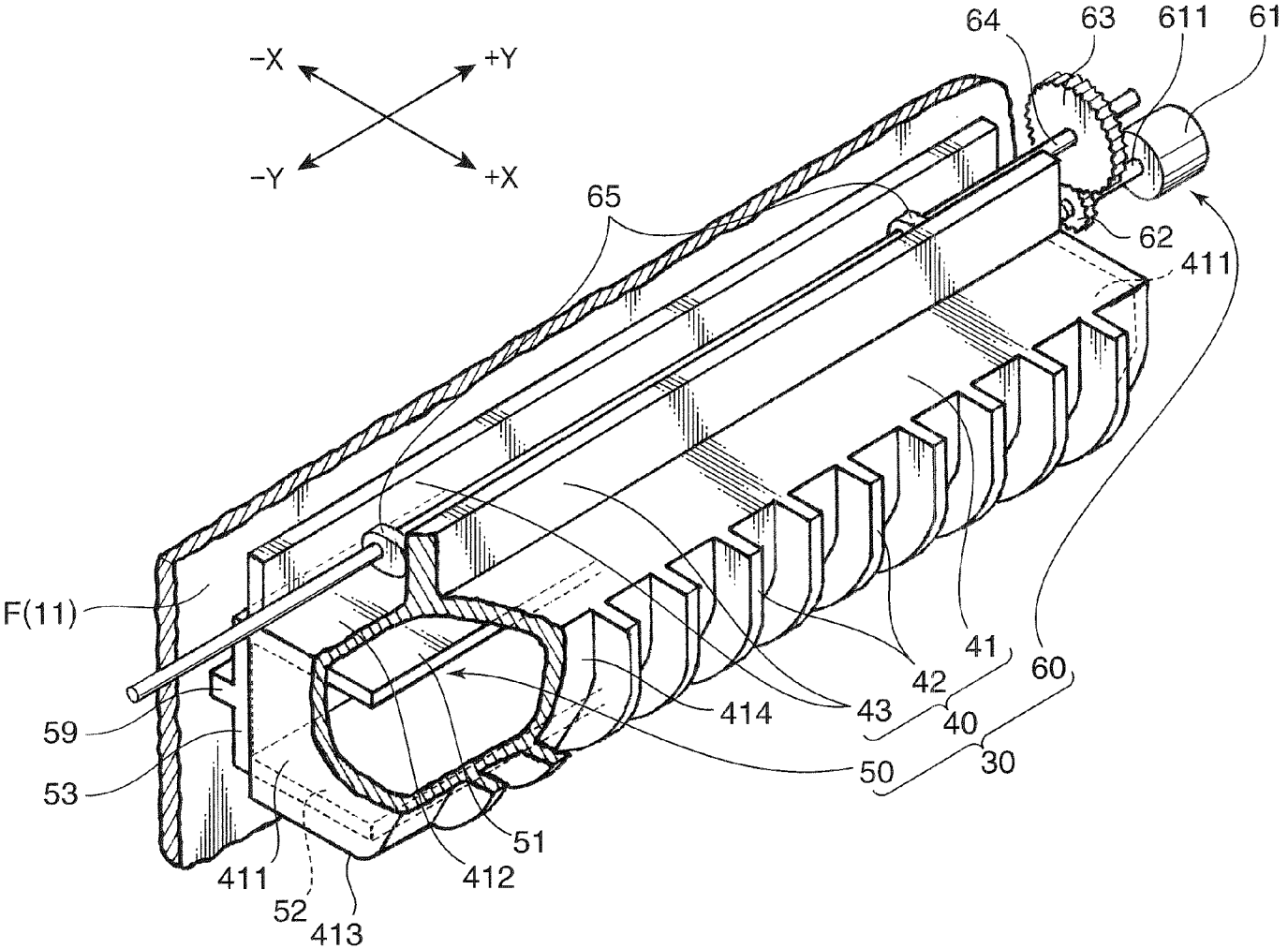
FIG. 3 is a partially cutaway perspective view of a sheet guiding structure of the first embodiment.

FIG. 3 is a partially cutaway perspective view of the sheet guiding structure 30 of the first embodiment, in which +X/−X denotes the left-right direction, −X representing the left direction and +X representing the right direction, and +Y/−Y denotes the front-rear direction, −Y representing a frontward direction and +Y representing a rearward direction. As shown in FIG. 3, the sheet guiding structure 30 includes the boxlike guide member 40 (the guide member) which can be moved closer to and away from the guiding fins 21, a support and guide member 50 for supporting the guide member 40 to guide the guide member 40 when the latter is moved closer to and away from the guiding fins 21, and a moving mechanism (guide member positioning mechanism) 60 for moving the boxlike guide member 40 in the leftward and rightward direction in a reciprocating manner.

The boxlike guide member 40 includes a boxlike body 41 having a generally parallelepiped external shape with an open left end, a plurality of guide ribs 42 formed on the right end of the boxlike body 41 at specific intervals along the front-rear direction, and a pair of left and right upright plates 43 projecting upward from a top surface of the boxlike body 41.

The boxlike body 41 has a pair of front and rear side plates 411 in the front-rear direction, a top plate 412 formed between upper edges of the two side plates 411, a bottom plate 413 formed between lower edges of the two side plates 411, and a right side plate 414 formed to interconnect the top plate 412 and the bottom plate 413. The left end of the boxlike body 41 is open. As seen in front view from the −Y direction, a lower half of the right side plate 414 forms a curved wall portion sloping rightward and upward in an arcuate shape, while an upper half of the right side plate 414 forms a flat wall portion extending generally straight upward from the curved wall portion.

The guide ribs 42 project rightward from the right side plate 414 of the boxlike body 41. Right ends of the guide ribs 42 form an arcuate shape in front view which generally matches the cross-sectional external shape of the right side plate 414. Thus, the sheet P discharged upward beyond the housing 133 of the fixing device 130 is transported rightward and upward while being guided by the guide ribs 42, and then is discharged onto the internal discharge tray 151 through the first sheet discharge path 102 or onto the external discharge tray 152 through the second sheet discharge path 103 depending on the position of the sheet discharge direction switching member 29.

The pair of upright plates 43 is used to move the boxlike guide member 40 in the leftward and rightward directions upon actuation of the moving mechanism 60. The upright plates 43 project parallel to each other upward from the top plate 412 of the boxlike body 41 all along the top plate 412 in the front-rear direction. As will be described later, generally oval-shaped eccentric cams 65 are fitted between the two upright plates 43 in a sliding contact manner.

The support and guide member 50 supports the boxlike guide member 40 in a manner that the boxlike guide member 40 can move back and forth along the left-right direction. The support and guide member 50 is generally C-shaped in front view seen from the −Y direction and has a top plate 51 of which top surface is held in sliding contact with a bottom surface of the top plate 412 of the boxlike body 41, a bottom plate 52 of which bottom surface is held in sliding contact with a top surface of the bottom plate 413 of the boxlike body 41, and a bridging plate 53 interconnecting left edges of the top plate 51 and the bottom plate 52.

The length of the support and guide member 50 along the front-rear direction is made slightly smaller than the distance between inner surfaces of the front and rear side plates 411 of the boxlike body 41, and the distance between the top surface of the top plate 51 and the bottom surface of the bottom plate 52 is made slightly smaller than the distance between inner surfaces of the top plate 412 and the bottom plate 413 of the boxlike body 41. In addition, the widths of the top plate 51 and the bottom plate 52 are made slightly smaller than the widths of the bottom plate 413 of the boxlike body 41, as measured along the left-right direction.

The support and guide member 50 is provided with a connecting plate 59 which is elongate in the front-rear direction, projecting leftward from a left surface of the bridging plate 53. The support and guide member 50 is connected to a predetermined frame F of the main apparatus body 11 by the connecting plate 59. As the support and guide member 50 is fitted over the boxlike guide member 40 in sliding contact, the boxlike guide member 40 can move back and forth along the left-right direction while being supported by the support and guide member 50 in a stable fashion.

The moving mechanism 60 includes a driving motor 61 mounted rearward of the support and guide member 50 and having a driving shaft 611, a driving gear 62 fitted on the driving shaft 611 so that the driving gear 62 turns on a common axis with the driving shaft 611, a driven gear 63 engaged with the driving gear 62 and having a larger diameter than the driving gear 62, a cam supporting shaft 64 so fitted to the driven gear 63 as to rotate coaxially with the driven gear 63 and extending in the front-rear direction, and the eccentric cams 65 which are fitted on the cam supporting shaft 64 so that the eccentric cams 65 turn integrally with the cam supporting shaft 64.

The cam supporting shaft 64 is made longer than the boxlike guide member 40 as measured along the front-rear direction. The cam supporting shaft 64 is so mounted as to be located between the two upright plates 43 projecting upward from the top plate 412 of the boxlike guide member 40, with both ends of the cam supporting shaft 64 mounted on front and rear frames (not shown) of the main apparatus body 11. While two eccentric cams 65 are mounted on the cam supporting shaft 64 in the present embodiment, there may be provided one eccentric cam 65 only, or three or more eccentric cams 65.

The eccentric cams 65 have generally an oval shape of which major axis has a length slightly smaller than the distance between inner surfaces of the two upright plates 43. It is therefore possible to fit the eccentric cams 65 between the two upright plates 43 in sliding contact even under conditions where the major axis of the eccentric cams 65 is oriented in the left-right direction. The cam supporting shaft 64 is fitted in the eccentric cams 65 to pass through one of focal points of each eccentric cam 65 so that the eccentric cams 65 turn integrally with the eccentric cam 65.

When activated, the driving motor 61 causes the cam supporting shaft 64 to turn on the axis thereof through the driving gear 62 and the driven gear 63. As a part of an oval periphery of each eccentric cam 65 located farther on the major axis from the cam supporting shaft 64 forces the left upright plate 43 leftward or the right upright plate 43 rightward, the boxlike guide member 40 is moved leftward or rightward while being guided by the support and guide member 50. This arrangement of the present embodiment makes it possible to move the boxlike guide member 40 of the sheet guiding structure 30 between an approached position (second position) T1 shown by the alternate long and two short dashed lines in FIG. 2 where the guide ribs 42 of the boxlike guide member 40 are approached to the guiding fins 21 of the sheet discharge direction switching mechanism 20 and a separated position (first position) T2 shown by the solid lines in FIG. 2 where the guide ribs 42 are moved away from the guiding fins 21.

Figure 4A:
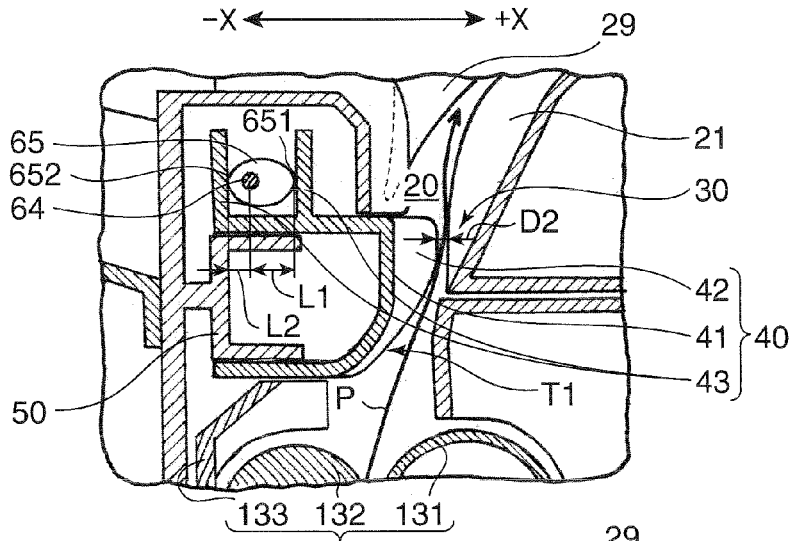
FIGS. 4A, 4B and 4C are front cross-sectional diagrams for explaining the working of the sheet guiding structure of the first embodiment, FIG. 4A showing a state in which guide ribs of a guide member of the sheet guiding structure are positioned at an approached position, FIG. 4B showing a state in which an eccentric cam is being turned for moving the guide member in order to shift the guide ribs from the approached position to a separated position, and FIG. 4C showing a state in which the guide ribs of the guide member are positioned at the separated position.
Figure 4B:
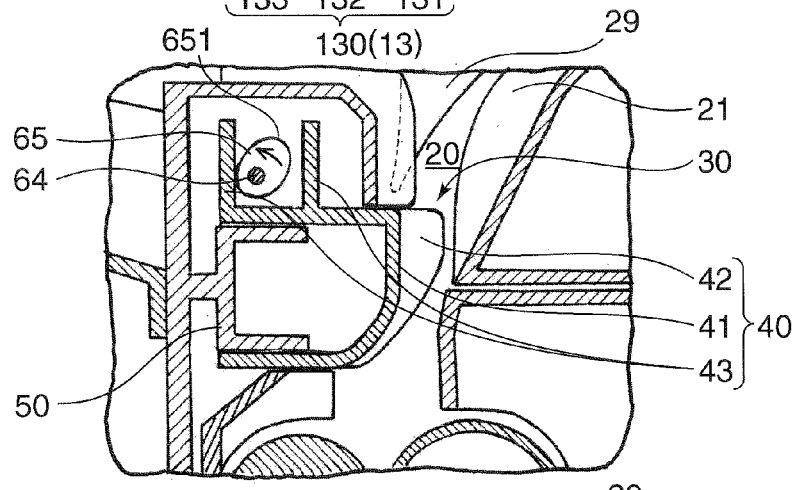
Figure 4C:
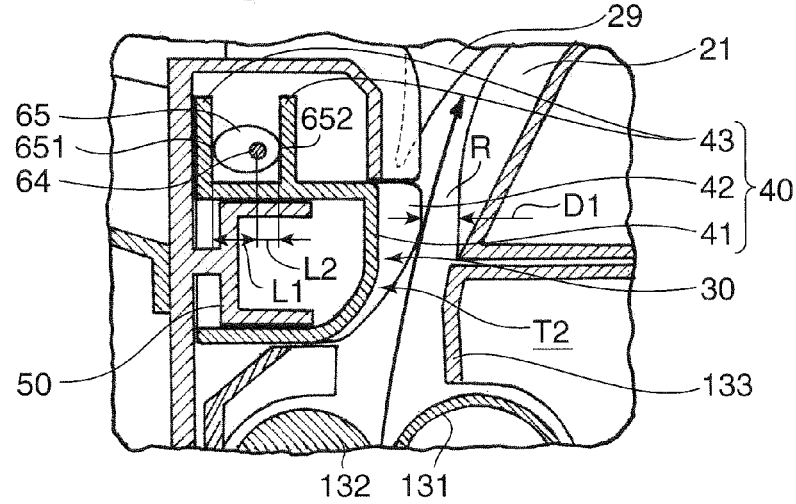

Now, the operation of the sheet guiding structure 30 of the first embodiment is described with reference to FIGS. 4A, 4B and 4C which are front cross-sectional diagrams for explaining the operation of the sheet guiding structure 30. Specifically, FIG. 4A shows a state in which the guide ribs 42 of the boxlike guide member 40 are positioned at the approached position T1, FIG. 4B shows a state in which the eccentric cams 65 are being turned for moving the boxlike guide member 40 of the sheet guiding structure 30 in order to shift the guide ribs 42 of the boxlike guide member 40 from the approached position T1 to the separated position T2, and FIG. 4C shows a state in which the guide ribs 42 of the boxlike guide member 40 are shifted to the separated position T2 where the guide ribs 42 are moved away from the guiding fins 21. It is to be noted that −X and +X shown in FIGS. 4A, 4B and 4C represent the same leftward and rightward directions as in FIGS. 1 to 3.

If the sheet P discharged from the fixing device 130 is an ordinary pliable sheet, the boxlike guide member 40 is set at the approached position T1 as shown in FIG. 4A. Each of the eccentric cams 65 has two opposing parts of its oval periphery on the major axis, which parts have different distances relative to the axis of the cam supporting shaft 64, with the cam supporting shaft 64 interposed between such two parts. One part is spaced a distance (L1) from the cam supporting shaft 64 and another part is spaced a distance (L2) from the cam supporting shaft 64, with the distance (L1) larger than the distance (L2). In the first embodiment, one part is referred to as a large-distance peripheral part 651 while another part is referred to as a short-distance peripheral part 652. When the boxlike guide member 40 is at the approached position T1, the large-distance peripheral part 651 of each eccentric cam 65 is in contact with the right upright plate 43 whereas the small-distance peripheral part 652 of each eccentric cam 65 is in contact with the left upright plate 43.

In this condition, the distance between the right ends of the guide ribs 42 of the boxlike guide member 40 and the left end surfaces of the guiding fins 21 is extremely small, and the sheet path R has a first width D2 as shown in FIG. 4A. A reason why the boxlike guide member 40 is set at the approached position T1 when the sheet P discharged from the fixing device 130 is an ordinary sheet is as follows.

Compared to a stiff sheet like a post card, the ordinary sheet is less stiff. The ordinary sheet becomes more flexible or more pliable, when heated in the fixing device 130. Thus, if the distance between the guide ribs 42 and the guiding fins 21 is large, the ordinary sheet discharged from the fixing device 130 may warp or become bent. Should this situation occur, it will not be able to smoothly feed the sheet P upward along the sheet path R, resulting in such inconvenience as a paper jam within the sheet discharge direction switching mechanism 20. To prevent this kind of inconvenience, the distance between the guide ribs 42 and the guiding fins 21 is made as small as possible when the sheet P discharged from the fixing device 130 is an ordinary sheet, so that the sheet P will not warp or become bent in sheet path R.

If the sheet P discharged from the fixing device 130 is a stiff sheet, on the other hand, the driving motor 61 (FIG. 3) is activated to turn the eccentric cams 65 counterclockwise on the cam supporting shaft 64 from a position shown in FIG. 4A, as shown by an arrow in FIG. 4B. When the eccentric cams 65 have been turned by 180 degrees as shown in FIG. 4C, the large-distance peripheral part 651 of each eccentric cam 65 forces the left upright plate 43 leftward, whereby the boxlike guide member 40 is moved leftward while being guided by the support and guide member 50. As a consequence, the boxlike guide member 40 is set at the separated position T2 where the distance between the right ends of the guide ribs 42 of the boxlike guide member 40 and the left end surfaces of the guiding fins 21 is increased and the sheet path R has a second width D1 which is larger than the first width D2.

In this condition, the stiff sheet P discharged from the fixing device 130 is fed generally straight upward without being forcibly warped rightward by the guide ribs 42, and then is discharged onto the internal discharge tray 151 or the external discharge tray 152 depending on the position of the sheet discharge direction switching member 29.

A reason why the boxlike guide member 40 is set at the separated position T2 when the sheet P is a stiff sheet is as follows. The stiff sheet P which has become flexible due to application of heat in the fixing device 130 is apt to assume a curled shape. If the boxlike guide member 40 is set at the approached position T1 as shown in FIG. 4A, the sheet path R between the guide ribs 42 and the guiding fins 21 is considerably narrow. In this condition, the stiff sheet P discharged from the fixing device 130 is forced relatively rightward by the guide ribs 42 while passing through the narrow sheet path R, as a consequence, the stiff sheet P assumes an inconveniently curled shape.

To prevent this problem, the boxlike guide member 40 is retracted from the guiding fins 21 in advance when the sheet P is a stiff sheet, so that the sheet path R between the guide ribs 42 and the guiding fins 21 is widened and an excessive force is not applied to the stiff sheet P.

Figure 5:
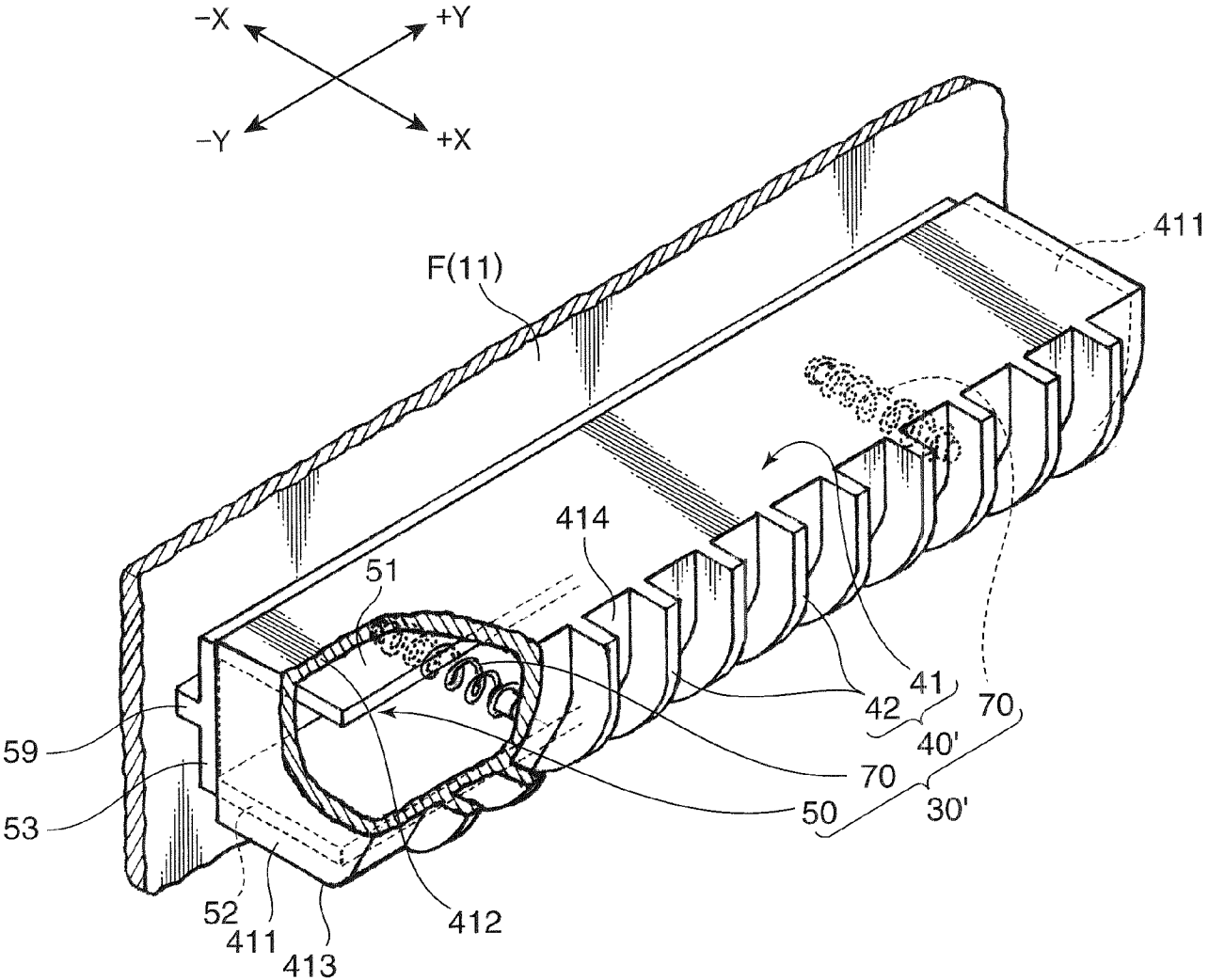
FIG. 5 is a partially cutaway perspective view of a sheet guiding structure according to a second embodiment of the invention.

Now, a sheet guiding structure 30' according to a second embodiment of the invention is described with reference to FIG. 5 which is a partially cutaway perspective view of the sheet guiding structure 30' of the second embodiment. It is to be noted that in FIG. 5 +X/−X denotes the same left-right direction, −X representing the leftward direction and +X representing the rightward direction, and +Y/−Y denotes the same front-rear direction, −Y representing the frontward direction and +Y representing the rearward direction as previously indicated in FIG. 3.

The sheet guiding structure 30' of the second embodiment is the same as the sheet guiding structure 30 of the first embodiment in that the sheet guiding structure 30' is provided with a boxlike guide member 40' which can be moved closer to and away from the guiding fins 21 and a support and guide member 50 for supporting the guide member 40' to guide the guide member 40' when the latter is moved closer to and away from the guiding fins 21. Unlike the sheet guiding structure 30 of the first embodiment, however, the sheet guiding structure 30' of the second embodiment does not include the moving mechanism 60 but includes a pair of coil springs (biasing members constituting a guide member positioning mechanism) 70 instead. Thus, a top plate 412 of the boxlike guide member 40' is not provided with the upright plates 43 which work with the moving mechanism 60 of the first embodiment. While the sheet guiding structure 30' includes two coil springs 70, there may be provided one coil spring 70 only, or three or more coil springs 70.

The bridging plate 53 of the boxlike structure supporting guide member (supporting member) 50 has hook-on projections 71 projecting rightward from the bridging plate 53. Also, the right side plate 414 of the boxlike guide member 40' has hook-on projections 72 projecting leftward from the right side plate 414 towards the hook-on projections 71. As opposite ends of the coil springs 70 are fitted on the hook-on projections 71 and the corresponding hook-on projections 72. The coil springs 70 are mounted in the boxlike guide member 40' in such a manner that the coil springs 70 can bias the boxlike guide member 40' in the rightward direction.

The length of each coil springs 70 is so set that the coil springs 70 assume an original length (i.e., the length when exerting no biasing force) when the boxlike guide member 40' is at the approached position T1.

Figure 6A:
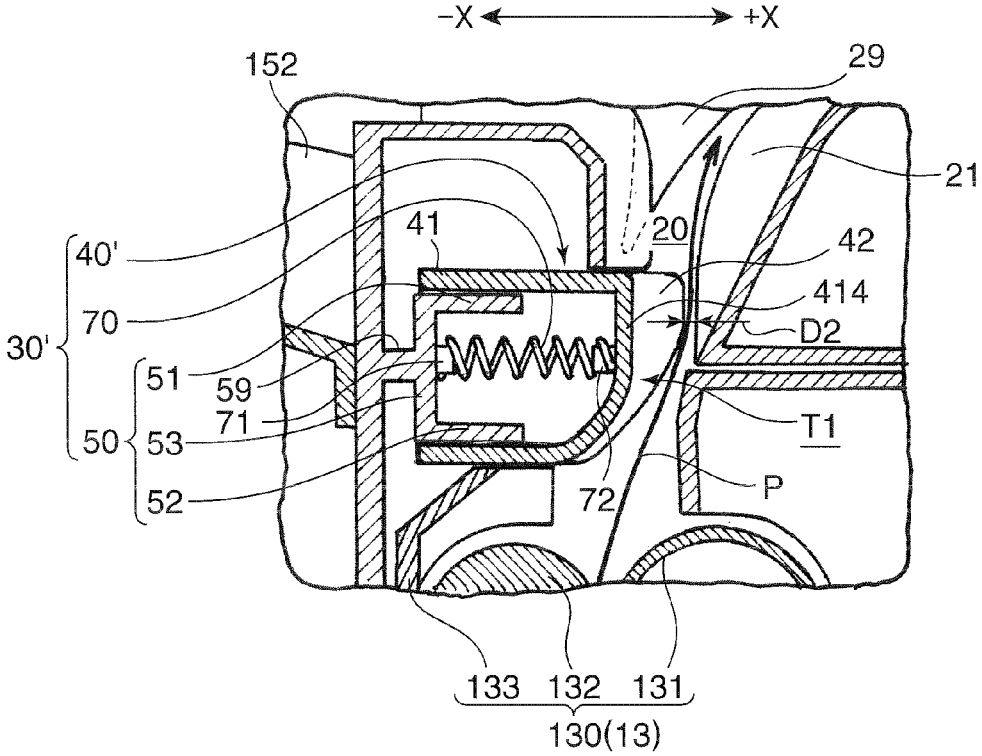
FIGS. 6A and 6B are front cross-sectional diagrams for explaining the working of the sheet guiding structure of the second embodiment, FIG. 6A showing a state in which the guide ribs of the guide member of the sheet guiding structure are positioned at the approached position, and FIG. 6B showing a state in which the guide ribs of the guide member are positioned at the separated position.
Figure 6B:
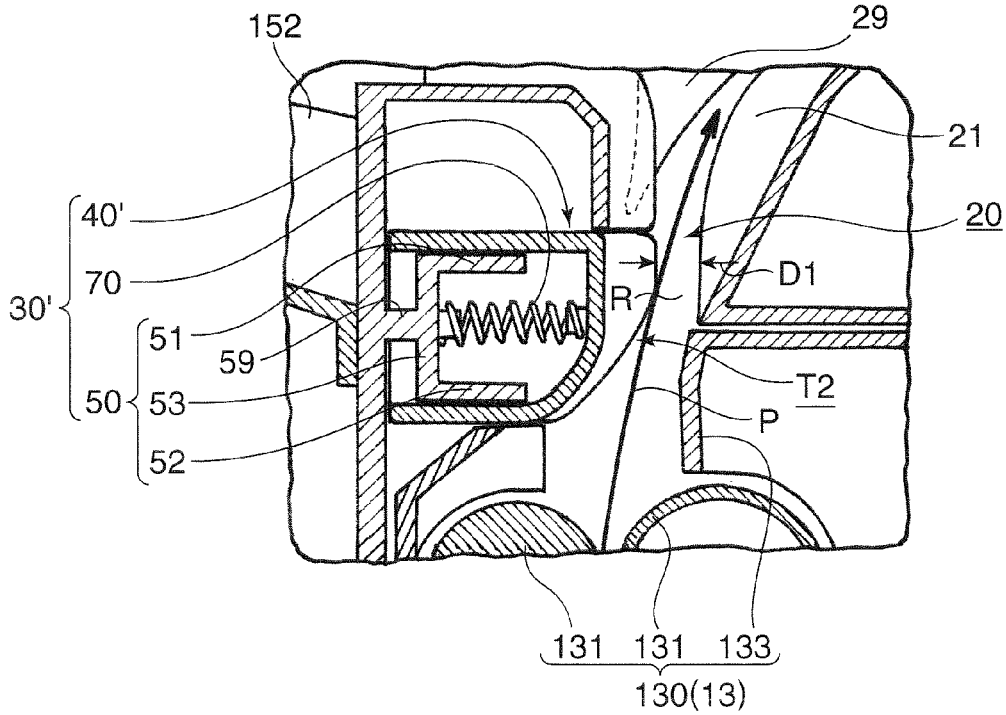

When an ordinary sheet P is discharged from the fixing device 130 under conditions where the boxlike guide member 40' is set at the approached position T1 as shown in FIG. 6A, the boxlike guide member 40' is not displaced leftward even if the sheet P interferes with the guide ribs 42 of the boxlike guide member 40'. The biasing force of the coil springs 70 is so determined that the boxlike guide member 40' is displaced leftward as shown in FIG. 6B when a stiff sheet P is discharged from the fixing device 130 and interferes with the guide ribs 42. In other words, the stiff sheet P resists the biasing force of the coil springs 70, forcing the guide member 40' to the approached position T1, to shift the guide member 40' from the approached position T1 to the separated position T2.

While the boxlike guide member 40' of the second embodiment produces the same operational and operation effects as the boxlike guide member 40 of the first embodiment when set in the approached position T1 and the separated position T2, it is not necessary to provide in the sheet guiding structure 30' the moving mechanism 60 including the driving motor 61, the driving gear 62, the driven gear 63, the cam supporting shaft 64 and the eccentric cam 65. Therefore, the second embodiment makes it possible to reduce the number of components and manufacturing cost of the sheet guiding structure 30.

As thus far described specifically with reference to the preferred embodiments, the image forming apparatus 10 includes the fixing device 130 for fixing a toner image formed on the sheet P by application of heat while the sheet P passes through the nip NP between the fixing roller 131 and the pressure roller 132 whose peripheral surface is pressed against the peripheral surface of the fixing roller 131, the guiding fins 21 located immediately downstream of the fixing device 130 at a position nearer to the fixing roller 131, the boxlike guide member 40 (40') disposed face to face with the guiding fins 21 at a position nearer to the pressure roller 132 for guiding the sheet P discharged from the fixing device 130 in cooperation with the guiding fins 21, and the guide member positioning mechanism (the moving mechanism 60 of first embodiment or the coil springs 70 of the second embodiment) for shifting the boxlike guide member 40 (40') between the separated position T2 where the boxlike guide member 40 (40') is moved from the guiding fins 21 and the approached position T1 where the boxlike guide member 40 (40') is moved closer to the guiding fins 21 than at the separated position T2.

According to this configuration, it is possible to cause the boxlike guide member 40 (40') to approach and draw back from the guiding fins 21 by shifting the boxlike guide member 40 (40') to the separated position T2 where the boxlike guide member 40 (40') is moved away from the guiding fins 21 or to the approached position T1 closer to the guiding fins 21 than the separated position T2 depending on stiffness of the sheet P. This makes it possible to prevent such a problem that the sheet P discharged from the fixing device 130 is curved due to interference with the boxlike guide member 40 (40') and a forward end of the sheet P becomes inconveniently curled.

More specifically, if the sheet P discharged from the fixing device 130 is a stiff sheet, the boxlike guide member 40 (40') is shifted in a direction in which the boxlike guide member 40 (40') is moved away from the guiding fins 21 and approaches the pressure roller 132. This serves to prevent the stiff sheet P, discharged from the fixing device 130, from bending as a result of interference with the boxlike guide member 40 (40'). It is therefore possible to prevent curling of the forward end of the stiff sheet P, although the conventional image forming apparatus has a problem that the stiff sheet discharged from the fixing unit becomes curled.

According to the foregoing embodiments, the stiff sheet P discharged from the fixing device 130 is guided in a direction in which the sheet P is fed apart from the fixing roller 131, so that the sheet P wraps on the fixing roller 131 over a smaller surface area thereof. This may potentially cause a problem that toner is not sufficiently fused by heat and part of the toner image once fixed to the sheet P is offset, or transferred, to the peripheral surface of the fixing roller 131. This problem can however be avoided by increasing the amount of heat supplied from a heat source built in the fixing roller 131.

Also, since the position of the boxlike guide member 40 is changed by the moving mechanism 60 in the sheet guiding structure 30 of the first embodiment, it is possible to move the boxlike guide member 40 in the direction in which the boxlike guide member 40 is moved away from the guiding fins 21 when the sheet P discharged from the fixing device 130 is a stiff sheet by operating the moving mechanism 60. This can be accomplished by entering the type of the sheet P through the operating unit 17 of the image forming apparatus 10 or detecting the type of the sheet P by an appropriate sensor, for example.

Since the moving mechanism 60 of the sheet guiding structure 30 changes the position of the boxlike guide member 40 by turning the eccentric cams 65 on the cam supporting shaft 64, it is possible to configure the moving mechanism 60 in simple design.

The sheet guiding structure 30' of the second embodiment employs the coil springs 70 instead of the moving mechanism 60. Since the boxlike guide member 40' of the sheet guiding structure 30' is forced toward the guiding fins 21 by the biasing force of the coil springs 70, the boxlike guide member 40' is normally positioned at the approached position T1. The biasing force of the coil springs 70 is set at such a level that the boxlike guide member 40' moves in the direction in which the boxlike guide member 40' is moved away from the guiding fins 21 as a result of interference with the sheet P when the sheet P discharged from the fixing device 130 is a stiff sheet.

According to this configuration, the sheet P interferes with the boxlike guide member 40' when the sheet P discharged from the fixing device 130 is a stiff sheet, and as a result, the sheet P shifts the boxlike guide member 40' in the direction in which the boxlike guide member 40' is moved away from the guiding fins 21, overwhelming the biasing force of the coil springs 70. It is therefore possible to prevent bending of the sheet P towards the fixing roller 131.

If the sheet P is an ordinary sheet, since the sheet P is pliable, the sheet P is delivered to the internal discharge tray 151 or the external discharge tray 152, whichever selected, through the sheet path R between the boxlike guide member 40' and the guiding fins 21 without shifting the boxlike guide member 40' away from the guiding fins 21.

In the second embodiment, the boxlike guide member 40' is biased toward the guiding fins 21 by the coil springs 70 having such a level of biasing force that the coil springs 70 do not elastically deform when the sheet P is an ordinary sheet but elastically deform when the sheet P is a stiff sheet. In this configuration, the sheet P causes the boxlike guide member 40' to be automatically separated away from the guiding fins 21 without any extra intervention when the sheet P is a stiff sheet. Accordingly, the sheet guiding structure 30' can be produced in simple design, resulting in a significant reduction in overall manufacturing cost of the image forming apparatus 10.

It should be recognized that the invention is not limited to the foregoing embodiments but includes various modifications and variations thereof as described hereinbelow, for example.

While the present invention has been described with reference to the first and second embodiments in which the image forming apparatus 10 is a copying machine, the image forming apparatus 10 of the invention is not limited to the copying machine but may be a printer or a facsimile machine, for example.

While the image forming apparatus 10 of the foregoing embodiments is provided with the fixing roller 131 which serves as a rotary pressure member, the image forming apparatus 10 may be modified to employ a structure including as a rotary pressure member a heating roller with a built-in heat source, a fixing roller with no heat source and a fixing belt mounted over the heating roller and the fixing roller instead of the fixing roller 131.

While the image forming apparatus 10 of the foregoing embodiments is provided with the boxlike guide member 40 (40') which can be moved back and forth as a constituent component of the sheet guiding structure 30 (30'), the image forming apparatus 10 may be modified to employ a simple platelike or rodlike movable guiding structure instead of the boxlike guide member 40 (40').

While the image forming apparatus 10 of the first embodiment is provided with the driving motor 61 in the moving mechanism 60 for varying the position of the boxlike guide member 40 depending on the type of the sheet P, the image forming apparatus 10 may be modified to employ a solenoid system instead of the driving motor 61.

Additionally, while the image forming apparatus 10 of the second embodiment is provided with the coil springs 70 as biasing members for forcing the boxlike guide member 40' toward the guiding fins 21, the image forming apparatus 10 may be modified to employ one or more leaf springs, spiral springs, or the like, as biasing members instead of the coil springs 70.

While the invention has thus far been described with reference to the illustrative embodiments thereof, principal arrangements and features of the invention can be summarized as follows.

An image forming apparatus includes a fixing unit having a rotary heating member and a rotary pressure member forming a nip in between, the fixing unit operable to fix a toner image formed on a transfer medium by applying heat to the toner image while passing the transfer medium through the nip, a guide wall positioned immediately downstream of the fixing unit and on the side of the rotary heating member with respect to a boundary defined by the transfer medium passing the nip, a guide member positioned on the side of the rotary pressure member with respect to the boundary and face to face with the guide wall, the guide member and the guide wall cooperatively guiding the transfer medium discharged from the fixing unit, and a guide member positioning mechanism for shifting the guide member between a first position where the guide member is moved away from the guide wall and a second position where the guide member is moved closer to the guide wall than at the first position.

The image forming apparatus thus configured can shift the guide member between the first position where the guide member is moved away from the guide wall and the second position where the guide member is moved closer to the guide wall than when the guide member is positioned at the first position, depending on stiffness (chiefly determined by thickness) of the transfer medium. This makes it possible to prevent such a problem that the transfer medium discharged from the fixing unit is curved towards the heating member due to interference with the guide member and a forward end of the transfer medium becomes inconveniently curled.

In the above image forming apparatus, the guide member positioning mechanism may include a biasing member capable of forcing the guide member toward the guide wall to shift the guide member between the first position and the second position.

Since the guide member is moved between the first position and the second position by the biasing member, the guide member positioning mechanism can be much simplified in structure, making it possible to reduce manufacturing cost of the image forming apparatus.

In the above image forming apparatus, the fixing unit passes at least two types of transfer medium, one type being a stiff transfer medium whereas another type being a pliable transfer media. The biasing force of the biasing member is so determined that when the stiff transfer medium is discharged from the fixing unit, interference of the stiff transfer medium with the guide member moves the guide member away from the guide wall to shift the guide member to the first position, and when the pliable transfer medium is discharged from the fixing unit, the guide member remains at the second position regardless of the interference of the pliable transfer medium with the guide member.

In the image forming apparatus thus configured, the transfer medium discharged from the fixing unit interferes with the guide member if the transfer medium is a stiff transfer medium, and as a result, the transfer medium overwhelms the biasing force of the biasing member and shifts the guide member to the first position where the guide member is moved away from the guide wall. It is therefore possible to prevent the transfer medium from being curved towards the rotary heating member.

If the transfer medium discharged from the fixing unit is a pliable transfer medium, on the other hand, the transfer medium having low stiffness is delivered to a specified discharge tray through a paper path formed between the guide member and the guide wall without shifting the guide member away from the guide wall (with the guide member remaining at the second position).

The above image forming apparatus may further include a support member for supporting the guide member in a manner that the guide member can move relative to the support member. The biasing member is preferably a coil spring fitted between the guide member and the support member to exert a biasing force for moving the guide member relative to the guide wall to thereby shift the guide member between the first position and the second position.

In the above image forming apparatus, the coil spring is configured to assume an original length when the guide member remains at the second position.

Since the coil spring assumes the original length when the guide member is at the second position in this configuration, it is possible to easily determine the second position of the guide member.

In the above image forming apparatus, the guide member positioning mechanism preferably includes an eccentric cam capable of rotating about an axis thereof to shift the guide member between the first position and the second position.

Since the guide member is moved between the first position and the second position by the eccentric cam, the guide member positioning mechanism can be simplified in structure, making it possible to reduce manufacturing cost of the image forming apparatus.

In the above image forming apparatus, the guide member preferably has a pair of contact plates and a cam supporting shaft disposed between the contact plates for supporting the eccentric cam, the cam supporting shaft supporting the eccentric cam rotatably and slidably between the pair of contact plates. The eccentric cam shifts the guide member to the first position by moving the guide member away from the guide wall when rotating to contact with one of the contact plates, and the eccentric cam shifts the guide member to the second position by moving the guide member toward the guide wall when rotating to contact with the other of the contact plates.

The above image forming apparatus may further include a sheet path formed between the guide member and the guide wall for passing the transfer medium discharged from the nip, the sheet path having a width that is set between a first width and a second width, both of which are defined by a gap between the guide member and the guide wall. when the guide member is shifted to the first position, the width of the sheet path is set to the first width in which the gap between the guide member and the guide wall is increased. On the other hand, when the guide member is shifted to the second position, the width of the sheet path is set to the second width in which the gap between the guide member and the guide wall is smaller than the first width.

In the image forming apparatus thus configured, the paper path has the first width when the guide member is at the first position and the second width when the guide member is at the second position. Since the width of the paper path can be changed in this fashion, it is possible to prevent the guide member from interfering with the transfer medium (especially the stiff transfer medium) discharged from the fixing unit, so that curling of the transfer medium can be avoided.

This application is based on Japanese Patent Application Serial No. 2008-053775, filed in Japan Patent Office on Mar. 4, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a fixing unit including a rotary heating member and a rotary pressure member forming a nip therebetween, the fixing unit operable to fix a toner image formed on a transfer medium by applying heat to the toner image while passing the transfer medium through the nip, wherein the fixing unit passes at least two types of transfer medium, one type being a stiff transfer medium whereas another type being a pliable transfer media; and a guide wall positioned immediately downstream of the fixing unit and on the side of the rotary heating member with respect to a boundary defined by the transfer medium passing the nip;

a guide member positioned on the side of the rotary pressure member with respect to the boundary and face to face with the guide wall, the guide member and the guide wall cooperatively guiding the transfer medium discharged from the fixing unit; and a guide member positioning mechanism for shifting the guide member between a first position where the guide member is moved away from the guide wall and a second position where the guide member is moved closer to the guide wall than at the first position, the guide member positioning mechanism includes a biasing member capable of forcing the guide member toward the guide wall to shift the guide member between the first position and the second position, wherein the biasing force of the biasing member is so determined that when the stiff transfer medium is discharged from the fixing unit, interference of the stiff transfer medium with the guide member moves the guide member away from the guide wall to shift the guide member to the first position, and when the pliable transfer medium is discharged from the fixing unit, the guide member remains at the second position regardless of the interference of the pliable transfer medium with the guide member.

2. The image forming apparatus according to claim 1, further comprising a support member for supporting the guide member in a manner that the guide member can move relative to the support member; and wherein the biasing member is a coil spring fitted between the guide member and the support member to exert a biasing force for moving the guide member relative to the guide wall to thereby shift the guide member between the first position and the second position.

3. The image forming apparatus according to claim 2, wherein the coil spring is configured to assume an original length when the guide member remains at the second position.

4. The image forming apparatus according to claim 1, further comprising a sheet path formed between the guide member and the guide wall for passing the transfer medium discharged from the nip, the sheet path having a width that is set between a first width and a second width, both of which are defined by a gap between the guide member and the guide wall, wherein when the guide member is shifted to the first position, the width of the sheet path is set to the first width in which the gap between the guide member and the guide wall is increased, whereas when the guide member is shifted to the second position, the width of the sheet path is set to the second width in which the gap between the guide member and the guide wall is smaller than the first width.

5. An image forming apparatus comprising:

a fixing unit including a rotary heating member and a rotary pressure member forming a nip therebetween, the fixing unit operable to fix a toner image formed on a transfer medium by applying heat to the toner image while passing the transfer medium through the nip;

a guide wall positioned immediately downstream of the fixing unit and on the side of the rotary heating member with respect to a boundary defined by the transfer medium passing the nip;

a guide member positioned on the side of the rotary pressure member with respect to the boundary and face to face with the guide wall, the guide member and the guide wall cooperatively guiding the transfer medium discharged from the fixing unit; and a guide member positioning mechanism for shifting the guide member between a first position where the guide member is moved away from the guide wall and a second position where the guide member is moved closer to the guide wall than at the first position, the guide member positioning mechanism includes an eccentric cam capable of rotating about an axis thereof to shift the guide member between the first position and the second position;

wherein the guide member has a pair of contact plates and a cam supporting shaft disposed between the contact plates for supporting the eccentric cam, the cam supporting shaft supporting the eccentric cam rotatably and slidably between the pair of contact plates; and wherein the eccentric cam shifts the guide member to the first position by moving the guide member away from the guide wall when rotating to contact with one of the contact plates, and the eccentric cam shifts the guide member to the second position by moving the guide member toward the guide wall when rotating to contact with the other of the contact plates.

6. The image forming apparatus according to claim 5, further comprising a sheet path formed between the guide member and the guide wall for passing the transfer medium discharged from the nip, the sheet path having a width that is set between a first width and a second width, both of which are defined by a gap between the guide member and the guide wall, wherein when the guide member is shifted to the first position, the width of the sheet path is set to the first width in which the gap between the guide member and the guide wall is increased, whereas when the guide member is shifted to the second position, the width of the sheet path is set to the second width in which the gap between the guide member and the guide wall is smaller than the first width.

* * * * *